US009758351B2

(12) United States Patent
Koketsu

(10) Patent No.: US 9,758,351 B2
(45) Date of Patent: Sep. 12, 2017

(54) ELEVATOR DOOR CONTROL DEVICE

(71) Applicant: Masahiko Koketsu, Tokyo (JP)

(72) Inventor: Masahiko Koketsu, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 259 days.

(21) Appl. No.: 14/766,921

(22) PCT Filed: Mar. 12, 2013

(86) PCT No.: PCT/JP2013/056799

§ 371 (c)(1),
(2) Date: Aug. 10, 2015

(87) PCT Pub. No.: WO2014/141384

PCT Pub. Date: Sep. 18, 2014

(65) Prior Publication Data

US 2016/0009528 A1 Jan. 14, 2016

(51) Int. Cl.
*B66B 13/14* (2006.01)
*B66B 13/12* (2006.01)

(52) U.S. Cl.
CPC ..... *B66B 13/143* (2013.01); *B66B 13/12* (2013.01); *B66B 13/146* (2013.01)

(58) Field of Classification Search
CPC ..... B66B 13/143; B66B 13/12; B66B 13/146
(Continued)

(56) References Cited

U.S. PATENT DOCUMENTS 4,832,158 A * 5/1989 Farrar ..... G05B 19/0421 187/316
5,131,506 A * 7/1992 Mizuno ..... G05D 3/12 187/316

(Continued)

FOREIGN PATENT DOCUMENTS

JP 2005-126176 A 5/2005
JP 2006-298538 A 11/2006

(Continued)

OTHER PUBLICATIONS

Office Action issued Jun. 30, 2016 in Korean Application No. 10-2015-7027795 (with English language translation).

(Continued)

*Primary Examiner* — Anthony Salata
(74) *Attorney, Agent, or Firm* — Oblon, McClelland, Maier & Neustadt, L.L.P.

(57) ABSTRACT

An elevator door control device includes: a car door panel and a hall door panel that open/close, respectively; a motor that drives the car door panel to open/close; jointing means for mechanically jointing the car door panel and the hall door panel to each other so that the panels open/close in an integrated manner; a closer device that provides a self-closing force in a door close direction to the hall door panel, and controller controlling the motor. The controller includes a torque detection unit that detects a torque of the motor in at least one of door closing and door opening of the panels when the panels are jointed to each other, and a diagnosis unit determines whether or not the hall door panel can self-close via the self-closing force when the panels are not jointed to each other, based on the torque detected by the torque detection unit.

6 Claims, 10 Drawing Sheets

(58) Field of Classification Search
USPC ..... 187/247, 277, 313, 316, 317, 391, 393
See application file for complete search history.

(56) References Cited

U.S. PATENT DOCUMENTS 5,170,865 A * 12/1992 Mizuno ..... G05D 3/12 187/316
5,250,765 A * 10/1993 Mizuno ..... G05D 3/12 187/293
5,373,120 A * 12/1994 Barrett ..... E05F 15/60 187/316
5,625,175 A * 4/1997 Gutknecht ..... G05B 19/416 187/316
5,760,350 A * 6/1998 Pepin ..... B66B 13/143 187/316
5,780,787 A * 7/1998 Kamani ..... B66B 13/143 187/316
5,817,993 A * 10/1998 Kamani ..... B66B 13/143 187/316
5,864,104 A * 1/1999 Tawada ..... B66B 13/146 187/316
6,508,332 B2 * 1/2003 Fahl ..... B66B 13/16 187/316
6,854,565 B2 * 2/2005 Perala ..... B66B 5/0006 187/247
9,586,790 B2 * 3/2017 Tyni ..... B66B 5/0006

FOREIGN PATENT DOCUMENTS

JP 2007-210695 A 8/2007
JP 2007-230685 A 9/2007
JP 2010-280495 A 12/2010
JP 2011-251802 A 12/2011
JP 2012-240789 A 12/2012
JP 2012-240791 A 12/2012
JP 2013-18577 A 1/2013

OTHER PUBLICATIONS

International Search Report Issued Jun. 11, 2013 in PCT/JP13/056799 Filed Mar. 12, 2013.
English translation of the International Preliminary Report on Patentability and Written Opinion issued Sep. 24, 2015 in PCT/JP2013/056799.

* cited by examiner

S1: SELF-DIAGNOSIS POSSIBLE?
S2: URGE PASSENGER(S) IN CAR TO GET OUT OF CAR
S3: MOVE TO FLOOR WHERE DIAGNOSIS IS INTENDED
S4: DOOR OPENING
S5: DOORS FULLY OPENED?
S6: STORE DATA DETECTED IN DOOR OPENING
S7: DIAGNOSIS OF WHETHER OR NOT HALL DOORS CAN SELF-CLOSE

S1: SELF-DIAGNOSIS POSSIBLE?
S2: URGE PASSENGER(S) IN CAR TO GET OUT OF CAR
S3: MOVE TO FLOOR WHERE DIAGNOSIS IS INTENDED
S4: DOOR OPENING
S5: DOORS FULLY OPENED?
S6: STORE DATA DETECTED IN DOOR OPENING
S11: DOOR CLOSING
S12: DOORS FULLY CLOSED?
S13: STORE DATA DETECTED IN DOOR CLOSING
S14: DIAGNOSIS OF WHETHER OR NOT HALL DOORS CAN SELF-CLOSE

S1: SELF-DIAGNOSIS POSSIBLE?
S2: URGE PASSENGER(S) IN CAR TO GET OUT OF CAR
S3: MOVE TO FLOOR WHERE DIAGNOSIS IS INTENDED
S4: DOOR OPENING
S5: DOORS FULLY OPENED?
S6: STORE DATA DETECTED IN DOOR OPENING
S7: DIAGNOSIS OF WHETHER OR NOT HALL DOORS CAN SELF-CLOSE
S22: PROCESSING FOR COMPARISON OF DETECTION DATA FOR PLURALITY OF FLOORS
A

Fig. 9

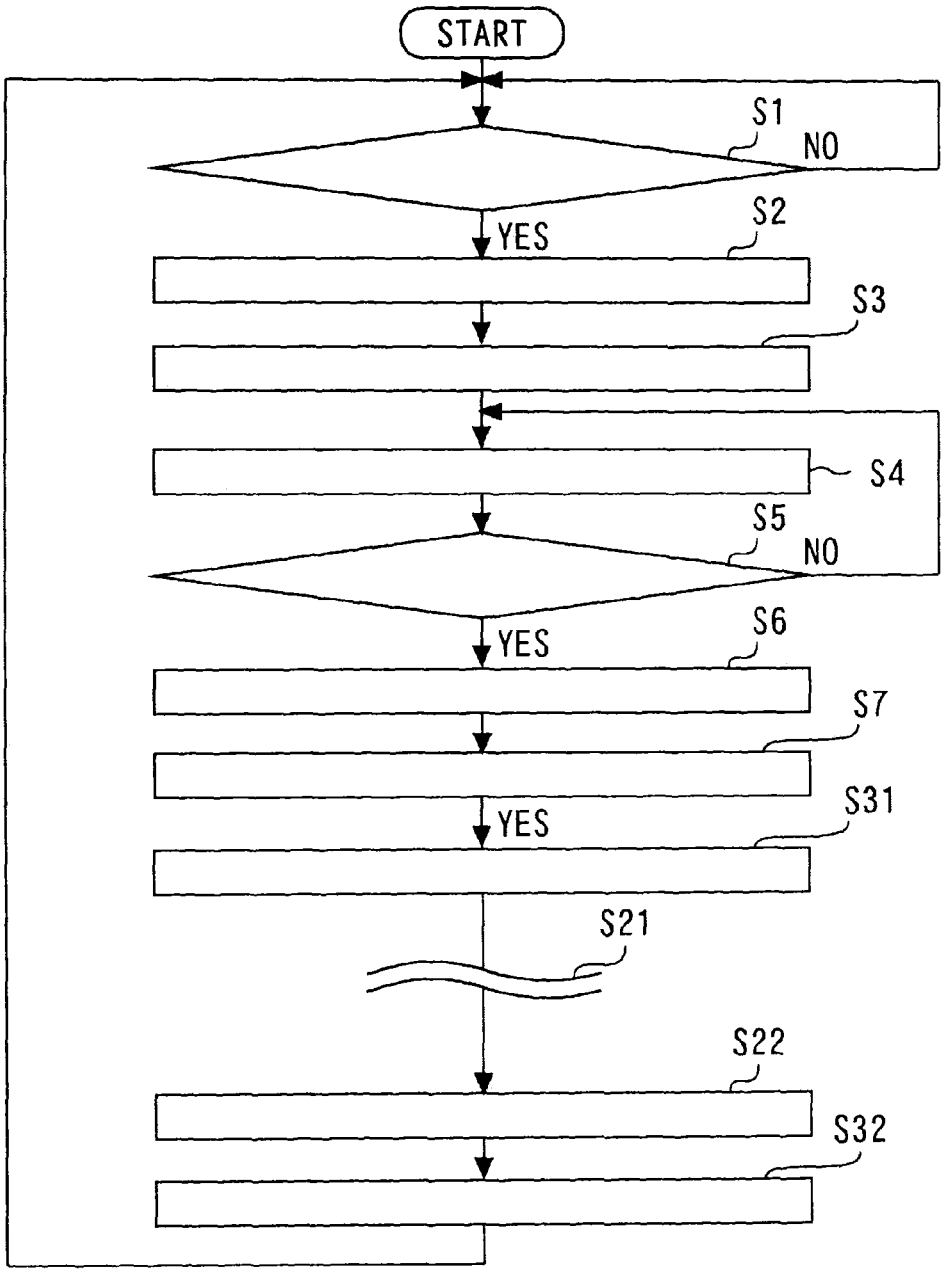

S1: SELF-DIAGNOSIS POSSIBLE?
S2: URGE PASSENGER(S) IN CAR TO GET OUT OF CAR
S3: MOVE TO FLOOR WHERE DIAGNOSIS IS INTENDED
S4: DOOR OPENING
S5: DOORS FULLY OPENED?
S6: STORE DATA DETECTED IN DOOR OPENING
S7: DIAGNOSIS OF WHETHER OR NOT HALL DOORS CAN SELF-CLOSE
S22: PROCESSING FOR COMPARISON OF DETECTION DATA FOR PLURALITY OF FLOORS
S31: STORE CALCULATED RUNNING LOSS
S32: PROCESSING FOR COMPARISON WITH PAST MEASUREMENT DATA

ELEVATOR DOOR CONTROL DEVICE

TECHNICAL FIELD

This invention relates to an elevator door control device.

BACKGROUND ART

As conventional elevator door control devices, door opening/closing abnormality monitoring devices for an elevator that has stopped in an earthquake emergency return operation after occurrence of an earthquake, in which with door open/close torque, door open/close time or the like stored in advance during normal time, a door open/close check operation is performed, which includes comparing door open/close torque, door open/close time or the like after occurrence of an earthquake with that of normal time, and if no abnormality is found in a door open/close diagnosis for the Standard Floor, the elevator is returned from the earthquake emergency mode into a door open/close diagnostic operation mode for each floor are known (see, for example, Patent Literature 1).

CITATION LIST

Patent Literature

Patent Literature 1: Japanese Patent Laid-Open No. 2007-230685

Patent Literature 2: Japanese Patent Laid-Open No. 2006-298538

Patent Literature 3: Japanese Patent Laid-Open No. 2007-210695

SUMMARY OF INVENTION

Technical Problem

In order to prevent hall doors of floors at which no car has stopped from being kept open, some of conventional elevators include a hall door closer device. The hall door closer device provides a self-closing force to a hall door in a direction in which the door is closed. Therefore, even if a hall door is opened for any reason when no car has stopped and a car door and the hall door are not jointed, the hail door can self-return to a full-close state by a self-closing force provided by the door closer device.

However, an increase in running loss in a hall door due to, e.g., aging may impair self-closing of the hall door. Therefore, it is necessary to check whether or not a hall door can self-close by means of a self-closing force provided by a hall door closer device.

However, in normal operation of an elevator, there are no situations in which hall doors solely open/close, and thus, conventionally, it is impossible to make a check (diagnosis) of whether or not hall doors can self-close in normal operation of an elevator. Therefore, conventionally, there is a problem that in a maintenance check periodically made, it is necessary for a maintenance personnel to check whether hall doors can self-close for all floors, which is very cumbersome and takes a lot of trouble.

Furthermore, in the conventional elevator door control device indicated in Patent Literature 1, the aforementioned issue regarding hall door self-closing has not been taken into account at all, and thus, diagnosis of whether or not a hall door can self-close by means of a self-closing force provided by a hall door closer device cannot be made.

This invention has been made to solve such problems, and is intended to provide an elevator door control device that enables automatic diagnosis of whether or not a hall door can self-close in an elevator including a hall door provided with a closer device.

Means for Solving the Problems

An elevator door control device according to the present invention includes: a car door panel configured to open/close an entrance of a car; a hall door panel configured to open/close an entrance of a hall; a motor configured to drive the car door panel to open/close; jointing means for mechanically jointing the car door panel and the hall door panel to each other so that the panels open/close in an integrated manner, a closer device configured to provide a self-closing force in a door close direction to the hall door panel; and control means for controlling the motor, wherein the control means includes a torque detection unit configured to detect a torque of the motor in at least one of door opening and door closing of the panels when the panels are jointed to each other, and a diagnosis unit configured to determine whether or not the hall door panel is self-closable via the self-closing force when the panels are not jointed to each other, based on the torque detected by the torque detection unit.

Advantageous Effect of Invention

An elevator door control device according to this invention provides an advantageous effect of enabling automatic diagnosis of whether or not a hall door can self-close in an elevator including hall doors each provided with a closer device.

BRIEF DESCRIPTION OF THE DRAWINGS

FIG. 9 is a flowchart illustrating operation of an elevator door control device related to Embodiment 4 of the present invention.

DESCRIPTION OF EMBODIMENTS

Figure 1:
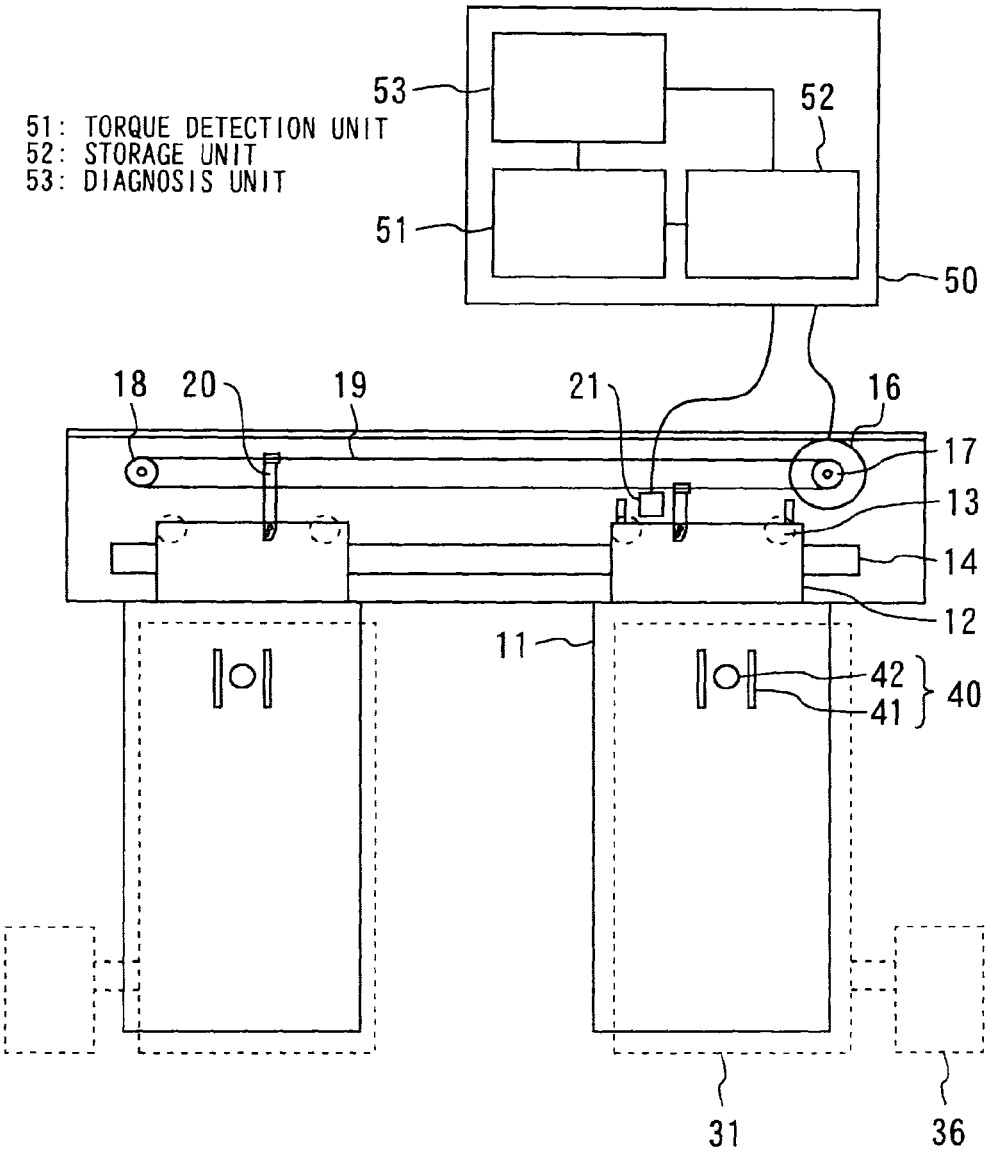
FIG. 1 is a front view of elevator doors equipped with an elevator door control device related to Embodiment 1 of the present invention.

This invention will be described with reference to the accompanying drawings. Through the drawings, same reference numerals indicate parts that are identical or correspond to each other, and overlapping description thereof will arbitrarily be simplified or omitted.

Embodiment 1

Figure 2:
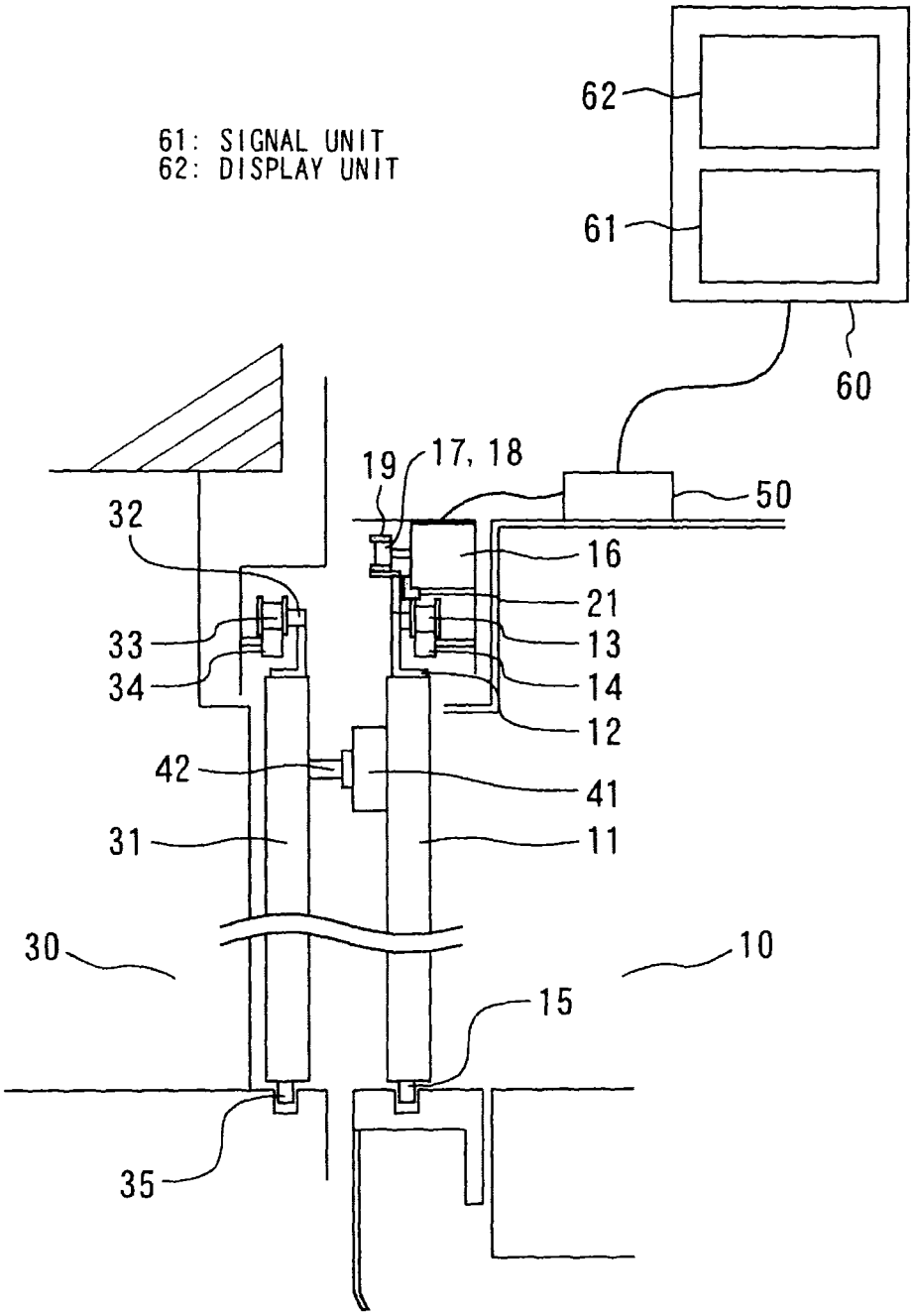
FIG. 2 is a side cross-sectional view of the elevator doors equipped with an elevator door control device related to Embodiment 1 of the present invention.
Figure 4A:
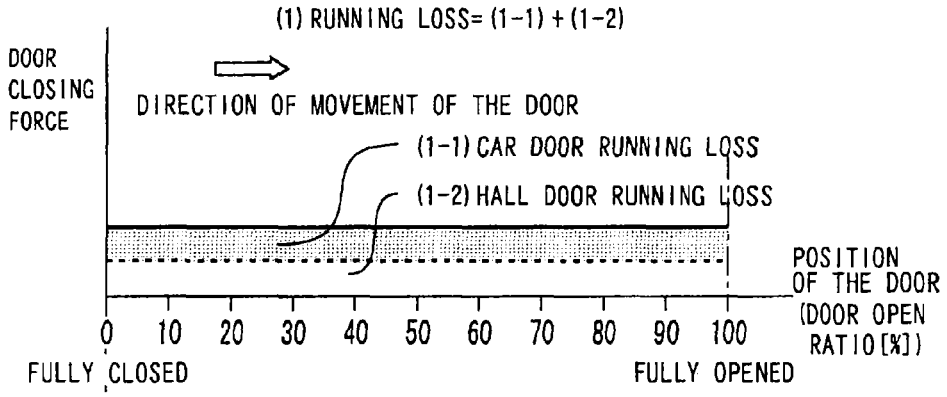
FIGS. 4A, 4B are diagrams illustrating a breakdown of running loss indicated in FIG. 3.
Figure 4B:
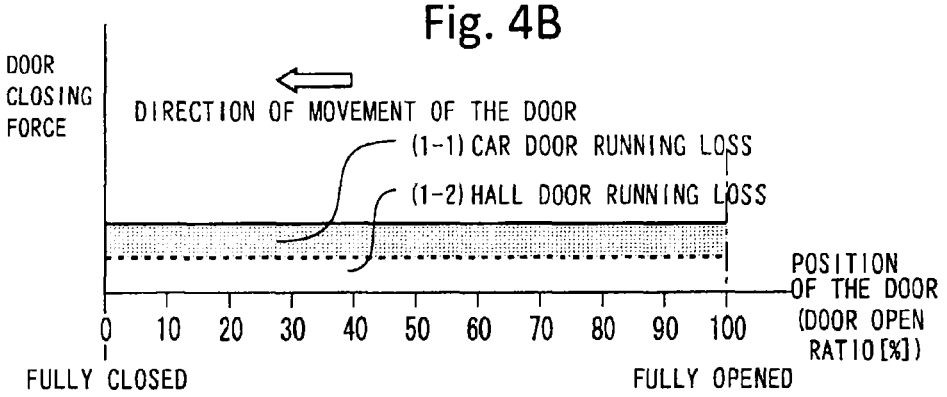
Figure 5A:
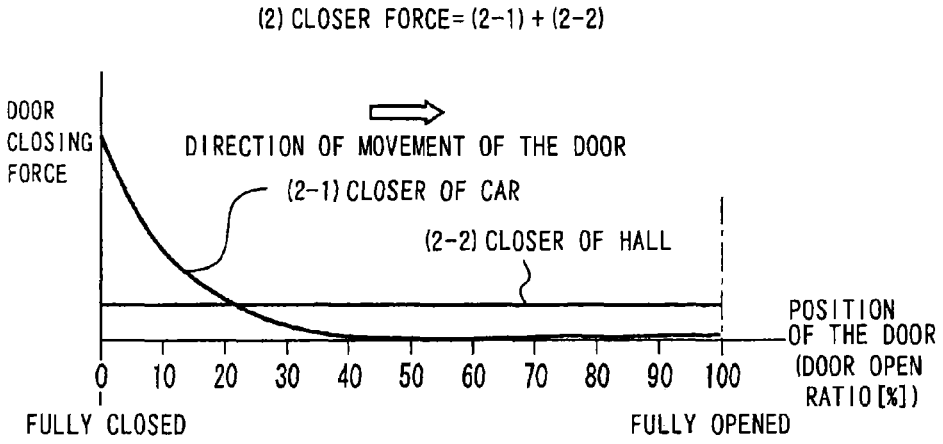
FIGS. 5A, 5B are diagrams illustrating a breakdown of a closer force indicated in FIG. 3.
Figure 5B:
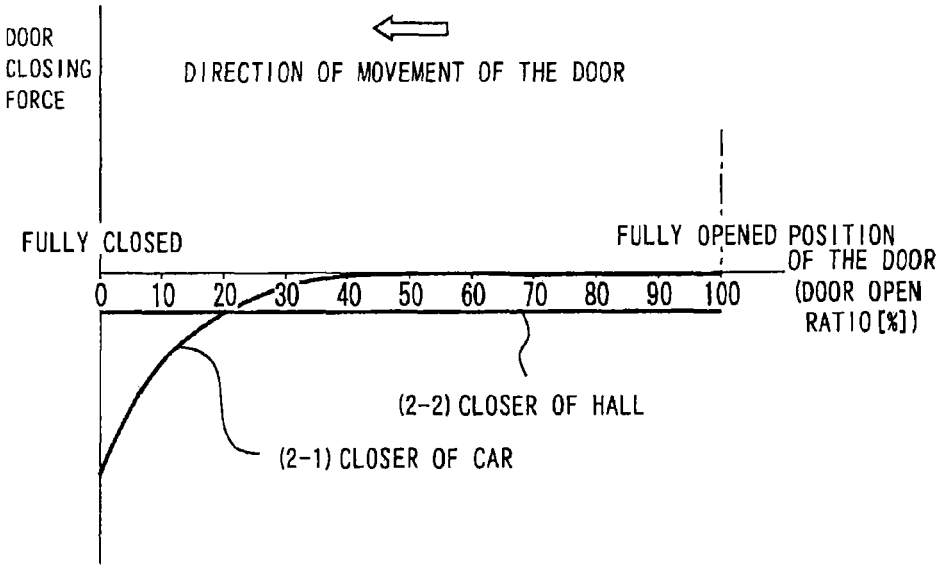
Figure 6:
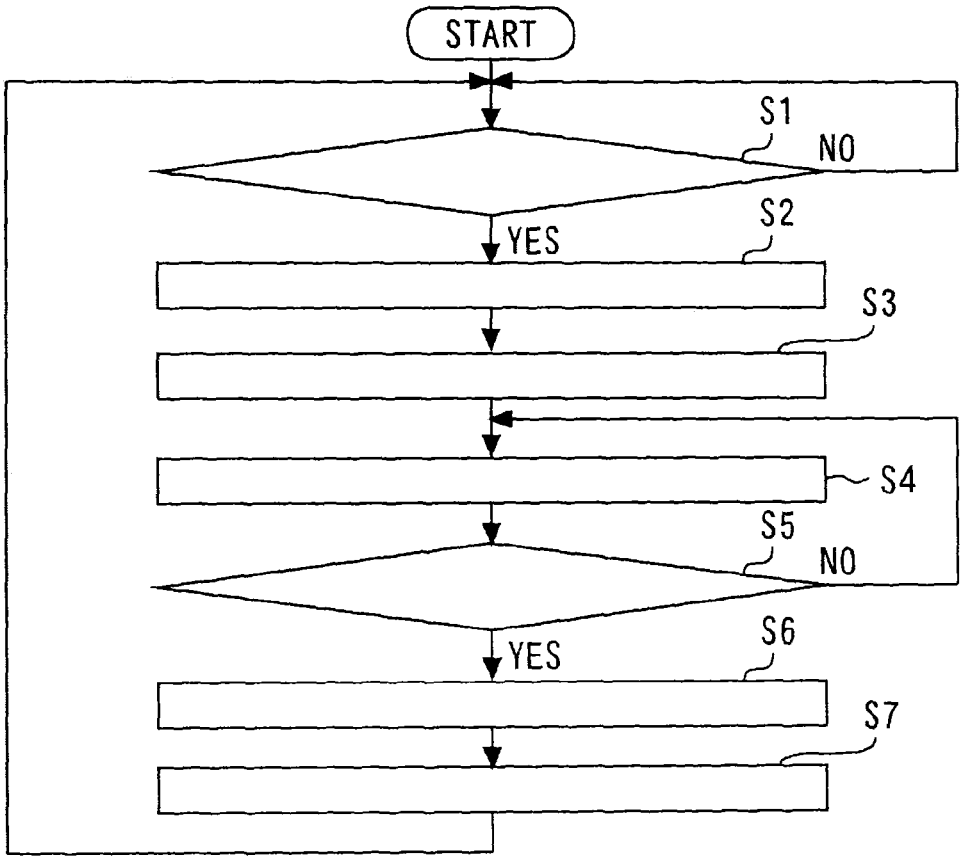
FIG. 6 is a flowchart illustrating operation of the elevator door control device related to Embodiment 1 of the present invention.

FIGS. 1 to 6 relate to Embodiment 1 of this invention: FIG. 1 is a front view of elevator doors equipped with an elevator door control device; FIG. 2 is a side cross-sectional view of the elevator doors equipped with an elevator door control device; FIGS. 3A, 3B are diagrams illustrating a force (torque) necessary for opening and closing of elevator doors, FIGS. 4A, 4B are diagrams illustrating a breakdown of running loss indicated in FIGS. 3A, 3B, FIGS. 5A, 5B are diagrams illustrating a breakdown of a closer force indicated in FIGS. 3A, 3B, and FIG. 6 is a flowchart illustrating operation of the elevator door control device.

In FIGS. 1 and/or 2, in a hoistway of a non-illustrated elevator, a car 10 is arranged so as to freely travel. The car 10 travels among a plurality of floors in the hoistway with, e.g., users loaded therein. In a front portion of the car 10, an entrance, which is an opening portion, is provided. In the entrance of the car 10, a pair of right and left car door panels 11, which are each included in a car door, are provided in a substantially horizontal direction so as to be openable/closable.

A car door hanger 12 is attached to an upper end portion of each of the car door panels 11. Car door rollers 13 are rotatably attached to an upper portion of each of the car door hanger 12. A car door rail 14 is attached above the entrance of the car 10. The car door rail 14 is attached substantially horizontally along a direction in which the car door panels 11 open/close. On the car door rail 14, the car door rollers 13 are provided in such a manner that the car door rollers 13 rollably engage with the car door rail 14.

Thus, the pair of right and left car door panels 11 is hung by the car door rail 14 via the car door hangers 12 and the car door rollers 13. Then, the car door rollers 13 are guided by the car door rail 14 and thereby roll on the car door rail 14, whereby the right and left car door panels 11 open/close the entrance of the car 10.

A car sill, which forms a lower edge portion of the entrance of the car 10, is attached to a lower front portion of the car 10. The car sill is attached substantially horizontally along the direction in which the car door panels 11 open/close. A guide groove is longitudinally provided in the car sill. A car door guide shoe 15 is attached to a lower end portion of each of the pair of right and left car door panels 11. The car door guide shoes 15 slidably engage with the inside of the guide groove of the car sill.

A door motor 16 is arranged above the car door rail 14 in the car 10. The door motor 16 is disposed on one side along the direction in which the car door panels 11 open/close, above the car door rail 14. A drive pulley 17 is secured to a drive shaft of the door motor 16. Also, a driven pulley 18 is attached to the other side along the direction in which the car door panels 11 open/close, above the car door rail 14.

An endless drive belt 19 is wrapped around the drive pulley 17 and the driven pulley 18. In such a manner described above, a wrapping transmission mechanism that transmits rotary driving of the door motor 16 to circulative movement of the drive belt 19 is formed.

A locking member 20 is attached to an upper end of the car door hanger 12 of one of the right and left car door panel 11. From among the locking members 20, the locking member 20 provided to one of the pair of right and left car door panels 11 engages with one of upper and lower parts of the drive belt 19 wrapped around the drive pulley 17 and the driven pulley 18. Also, the locking member 20 provided to the other of the pair of right and left car door panels 11 engages with the other of the upper and lower parts of the drive belt 19 wrapped around the drive pulley 17 and the driven pulley 18.

With such configuration as described above, rotary diving in both normal and reverse directions of the door motor 16 is transformed to circulative movement in both directions of the drive belt 19, whereby the pair of right and left car door panels 11 travels in respective directions opposite to each other and the entrance of the car 10 opens/closes.

A car door switch 21 is attached to a position above the car door hanger 12 of any one of the pair of right and left car door panels 11 in the car 10. The car door switch 21 is intended to detect that the car door panel 11 is located at a full-open position or a full-close position. Here, the "Ml-open position" refers to a position at which the entrance of the car 10 is fully opened by the car door panels 11. Also, the "full-close position" refers to a position at which the entrance of the car 10 is fully closed by the car door panels 11.

A hall 30 is provided on a floor at which the car 10 stops. An entrance, which is an opening portion, is provided in a wall portion between the hall 30 and the hoistway. The entrance of the hall 30 is provided at a position facing the entrance of the car 10 when the car 10 stops at the floor of the hall 30. Hall door panels 31, which are included in a pair of right and left hall doors, are provided so as to be openable/closable in a substantially horizontal direction in the entrance of the hall 30.

A hall door hanger 32 is attached to an upper end portion of each of the hall door panels 31. Hall door rollers 33 are rotatably attached to an upper portion of each of the hall door hangers 32. A hall door rail 34 is attached to a hoistway-side position above the entrance of the hall 30. The hall door rail 34 is attached substantially horizontally along a direction in which the hall door panel 31 opens/closes. On the hall door rail 34, the hall door rollers 33 are provided in such a manner that the hall door rollers 33 rollably engage with the hall door rail 34.

In such a manner as described above, the pair of right and left hall door panels 31 is hung by the hall door rail 34 via the hall door hangers 32 and the hall door rollers 33. Then, the hall door rollers 33 are guided by the hall door rail 34 and thereby roll on the hall door rail 34, whereby the right and left hall door panels 31 open/close the entrance of the hall 30.

In a floor surface that forms a lower edge portion of the entrance of the hall 30, a guide groove is provided along a direction in which the hall door panel 31 opens/closes. A hall door guide shoe 35 is attached to a lower end portion of each of the pair of right and left hall door panels 31. The hall door guide shoes 35 slidably engage with the inside of the guide groove provided in the lower edge portion of the entrance of the hall 30.

A jointing device 40 is provided on a hoistway-side surface of each of the car door panels 11 and a hoistway-side surface of each of the hall door panels 31. The jointing devices 40 each include car-side plates 41 and a hall-side roller 42. The car-side plates 41 are a pair of plates provided so as to project toward the hoistway on the hoistway-side surface of the relevant car door panel 11. The hall-side roller 42 includes a roller attached to a tip of a bar-like member provided so as to project toward the hoistway on the hoistway-side surface of the relevant hall door panel 31. The car-side plates 41 and the hall-side roller 42 are disposed at positions facing each other when the car 10 stops at the floor of the hall 30.

When the car 10 stops at the floor of the hall 30, the car-side plates 41 and the hall-side roller 42 of the jointing device 40 engage with each other, whereby the car door panels 11 and the hall door panels 31 are mechanically jointed. Then, upon the car door panels 11 being opened/closed by power of the door motor 16, the car door panels 11 and the hall door panels 31 coordinate with each other and are opened/closed in an integrated manner.

As specifically illustrated in FIG. 1, the hall doors each include a hall door closer device 36. The hall door closer devices 36 are intended to provide a self-closing force in respective door close directions to the respective hall door panels 31. The hall door closer devices 36 consistently provides a self-closing force of a predetermined magnitude to the respective hall door panels 31 in the respective door close directions.

Therefore, when the car door panels 11 and the hall door panels 31 are not jointed by the jointing devices 40, the hall door panels 31 self-close by the self-closing force applied from the hall door closer devices 36 to the hall door panels 31.

Also, as with the hall doors, the car doors each include a non-illustrated car door closer device. The car door closer devices provide a self-closing force in respective door close directions to the respective car door panels 11. Since the car doors are basically opened/closed by a driving force of the door motor 16, it is not necessarily required to provide the car door closer devices.

As specifically illustrated in FIG. 2, on an upper surface of a ceiling of the car 10, a car door control device 50 is installed. The car door control device 50 controls motion of the door motor 16, thereby controlling opening/closing of the car door panels 11.

The car door control device 50 grasps positions of the car door panels 11 based on a detection signal from a car door switch 21 and a signal from a non-illustrated pulse encoder provided in the door motor 16. Here, the pulse encoder generates and outputs a pulse signal according to an amount of rotation of the door motor 16. Then, based on the thus-grasped positions of the car door panels 11, the car door control device 50 controls motion of the door motor 16.

The car door control device 50 is connected to a control panel 60 via a communication table. The control panel 60 is intended to control overall operation of the elevator, and corresponds to an upper device for the car door control device 50. The car door control device 50 controls opening/closing of the car doors based on an instruction from the control panel 60.

As specifically illustrated in FIG. 1, the car door control device 50 includes a torque detection unit 51, a storage unit 52 and a diagnosis unit 53. The torque detection unit 51 detects torque of the door motor 16 in at least one of door opening and closing in the elevator based on a current value output from the car door control device 50 to the door motor 16 and the signal from the pulse encoder. The storage unit 52 stores a value of the torque detected by the torque detection unit 51.

The diagnosis unit 53 makes diagnosis of whether or not there is an abnormality in a self-closing force provided by the hall door closer devices 36 to the hall door panels 31, based on the value of the torque in door opening and/or closing, which is stored in the storage unit. Here, the diagnosis unit 53 makes the diagnosis not using information stored in the storage unit, but directly using a torque value detected by the torque detection unit 51.

Figure 3A:
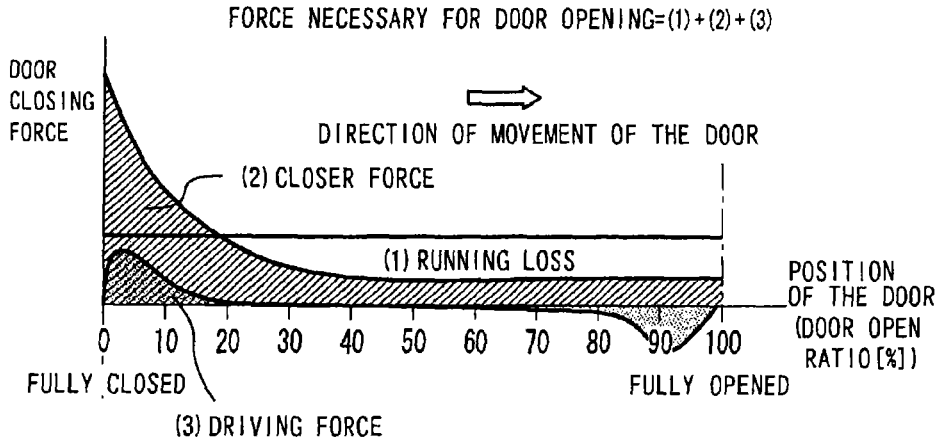
FIGS. 3A, 3B are diagrams illustrating a force (torque) necessary for opening and closing of elevator doors.
Figure 3B:
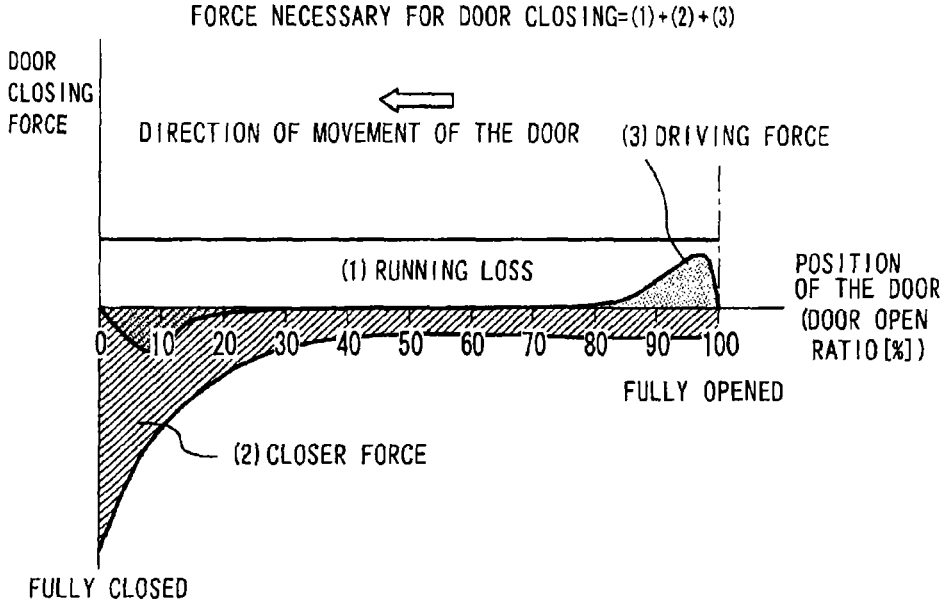

A principle of diagnosis of the hall door closer devices 36 made by the diagnosis unit 53 based on a value of torque of the door motor 16 in door opening and/or closing will be described with reference to FIGS. 3A, 3B to 5. FIGS. 3A, 3B are diagrams illustrating a force (torque) necessary for opening/closing a door of an elevator.

FIG. 3A schematically illustrates a force (torque) necessary for opening a door of an elevator. In FIG. 3A, the abscissa represents a position of the door in terms of a door open ratio (%). A door open ratio of 0% means a state in which the door is fully closed, and a door open ratio of 100% means a state in which the door is fully opened. In FIG. 3A, for a door opening force on the ordinate, a force in a direction against a direction of movement of the door is positive.

As elements forming a force (torque) necessary for opening a door of an elevator, there are three elements, which are a running loss (1), a closer force (self-closing force) (2) and a driving force (3) indicated in FIG. 3A. A force necessary for door opening (door opening force) is a total sum of the running loss (1), the closer force (2) and the driving force (3).

(1) A running loss mainly includes a frictional force acting on the car door panels 11 and the hall door panels 31 when the car door panels 11 and the hall door panels 31 move. The running loss occurs in a direction opposite to a direction of movement of the door. FIG. 4A indicates a breakdown of a running loss when a door of an elevator opens.

As illustrated in FIG. 4A, a running loss in door opening of a door of an elevator is a sum of a car door running loss (1-1) and a hall door running loss (1-2). These running losses can be regarded as being consistently constant irrespective of a position of the door. Therefore, as illustrated in FIG. 3A, a running loss in opening of a door of an elevator has a constant value irrespective of a position of the door.

The closer force (2) is a force acting on the car door panels 11 and the hall door panels 31, the closer force (2) being provided by the hall door closer device 36 and (if provided) the car door closer device. The closer force is exerted in a door-close direction of the door. In other words, in opening of the door, the closer force is exerted in a direction opposite to a direction of movement of the door.

FIG. 5A indicates a breakdown of a closer force in opening of a door of an elevator. Thus, a closer force (2-2) applied by the hall door closer device 36 is set to be constant irrespective of a position of the door. On the other hand, a closer force (2-1) applied by the car door closer device is set to be larger as the door is close to a full-close position, and be smaller as the door is closer to a full-open position.

More specifically, the closer force (2-1) from the car door closer device is maximum at a door open ratio of 0%. Then, as the closer force (2-1) decreases as the door open ratio increases, and is substantially zero when the door open ratio is 40% or more. Therefore, as illustrated in FIG. 3A, the closer force (2), which is a sum of (2-1) and (2-2), has a maximum value when the door open ratio is 0%, decreases as the door open ratio increases, and has a substantially constant value when the door open ratio is in a range of 40% to 100%.

(3) The driving force is a force necessary for accelerating or decelerating the car door panels 11 and the hall door panels 31. Therefore, the driving force is determined by masses and acceleration or deceleration of the car door panels 11 and the hall door panels 31. From another perspective, the driving force can be regarded as an inertia force acting on the car door panels 11 and the hall door panels 31. The driving force is exerted in a direction opposite to a direction of movement of the door in acceleration, and is exerted in a direction that is the same as the direction of movement of the door.

Therefore, as illustrated in FIG. 3A, a driving force in opening of a door of an elevator is exerted in a direction opposite to a direction of movement of the door in a door open ratio rang of 0% to around 20% in which the door starts opening and accelerates. On the other hand, in a door open ratio range of around 80% to around 100% in which the door decelerates in order to terminate the door opening, the driving force is exerted in a direction that is the same as the direction of movement of the door. Also, in a door open ratio range of around 20% to around 80% in which the door moves at a substantially constant speed, the driving force is substantially zero.

FIG. 3B schematically illustrates a force (torque) necessary for closing a door of an elevator. In FIG. 3B, also, as in FIG. 3A, the abscissa represents a position of the door in door open ratio (%). In FIG. 3B, for a door closing force on the ordinate, a force against a direction of movement of the door is positive.

As elements forming a force (torque) necessary for closing a door of an elevator, as in the door opening, there are three elements, which are a running loss (1), a closer force (self-closing force) (2) and a driving force (3) indicated in FIG. 3B. However, the closer force (2) is exerted in a direction in which the closer force (2) makes the door close irrespective of a direction of movement of the door, and thus, in closing the door, the closer force (2) is exerted in a direction that is the same as the direction of movement of the door. Accordingly, a force necessary for door closing (door close force) is one resulting from the closer force (2) being subtracted from a sum of the running loss (1) and the driving force (3).

The running loss (1) occurs in a direction opposite to the direction of movement of the door. FIG. 4B indicates a breakdown of a running loss in closing of a door of an elevator. As described above, a running loss in closing of doors of an elevator is one resulting from adding up a car door running loss (1-1) and a hall door running loss (1-2). These running losses can be regarded as being consistently constant irrespective of a position of the doors. Therefore, as illustrated in FIG. 3B, a running loss in closing of doors of an elevator is constant irrespective of a position of the doors.

The closer force (2) is exerted in a direction in which the door closes. In other word, in closing of the door, the closer force is exerted in a direction that is the same as the direction of movement of the door. FIG. 5B indicates a breakdown of a closer force in closing of a door of an elevator. As described above, a magnitude of the closer force (2-2) applied by the hall door closer device 36 is set so as to be constant irrespective of the position of the door. On the other hand, the magnitude of the closer force (2-1) applied by the car door closer device has a maximum value at a door open ratio of 0%, and decreases as the door open ratio is larger, and is substantially zero at a door open ratio of 40% or more.

Therefore, as illustrated in FIG. 3B, the magnitude of the closer force (2) has a maximum value at a door open ratio of 0%, decreases as the door open ratio is larger, and is a substantially constant value in a door open ratio range of 40% to 100%. Since the direction of the closer force (2) is the same as the direction of movement of the doors, and thus, on the ordinate representing the door closing force, the closer force (2) consistently has a negative value.

The driving force (3) is a force necessary for accelerating or decelerating the car door panels 11 and the hall door panels 31. The driving force is exerted in a direction opposite to a direction of movement of the doors in acceleration and is exerted in a direction that is the same as the direction of the movement of the doors in declaration.

Therefore, as illustrated in FIG. 3B, the driving force in closing of a door of an elevator is exerted in a direction opposite to a direction of movement of the door in a door open ratio range of 100% to around 80% in which the door starts closing and the door accelerates. On the other hand, in a door open ratio range of around 20% to around 0% in which the door decelerates in order to terminate the door closing, the driving force is exerted in a direction that is the same as a direction of movement of the door. Also, in a door open ratio range of around 80% to around 20% in which the door moves at a substantially constant speed, the driving force is substantially zero.

As described above, a force necessary for opening/closing of doors of an elevator is formed from three elements: a running loss (1), a closer force (2) and a driving force (3). From among these elements, it is normally rare that the closer force (2) and the driving force (3) largely vary in magnitude if operation of the elevator is continued after installation of the elevator. On the other hand, (1) a running loss easily increases as a result of continuation of operation of the elevator.

Here, in order to make the hall door panel 31 self-close when the car door panel 11 and the hall door panel 31 are released from the jointing via the jointing device 40, it is necessary that the hall closer force (2-2) illustrated in FIGS. 5A, 5B be larger than the hall door running loss (1-2) illustrated in FIGS. 4A, 4B. Therefore, in particular, an increase in hall door running loss (1-2) due to aging is most likely to prevent the hall door panel 31 from self-closing.

Therefore, the car door control device 50 estimates a magnitude of the running loss (1) based on a torque of the door motor 16 necessary for at least one of the door opening and door closing when the car door panel 11 and the hall door panel 31 are jointed by the jointing device 40, and make diagnosis of whether or not the hall door panel 31 can self-close by means of the hall door closer device 36 from the estimated running loss (1) as follows.

First, the torque of the door motor 16 necessary for at least one of the door opening and door closing when the car door panel 11 and the hall door panel 31 are jointed by the jointing device 40 is detected by the torque detection unit 51. Here, an acceleration and a declaration of the door in door opening motion and/or door closing motion are made to be small to the possible extent to reduce the driving force (3), whereby an effect of the driving force (3) can be ignored.

Next, the diagnosis unit 53 subtracts the closer force (2) (if the torque value is based on one in door opening) from the torque value detected by the torque detection unit 51 or adds the closer force (2) (if the torque value is based on one in door closing) to the torque value detected by the torque detection unit 51, whereby an estimated value of the running loss (1) can be obtained. This is because, as described above, an effect of the driving force (3) can be ignored by making an acceleration and a declaration of the doors in door opening motion and/or door closing motion small to the possible extent. Here, a magnitude of the closer force (2) is calculated and stored in, for example, the storage unit 52 in advance.

Then, the diagnosis unit 53 compares a magnitude of the thus-estimated running loss (1) with a predetermined reference value to make diagnosis of whether or not the hall door panels 31 can self-close by means of the hall door closer devices 36. The diagnosis can be made for each of the floors at which the car 10 stops.

If the diagnosis unit 53 provides the diagnosis of the hall door panels 31 being unable to self-close by means of the hall door closer devices 36 (self-closing force abnormality), the car door control device 50 transmits a self-closing force abnormality signal to the control panel 60. The self-closing force abnormality signal contains information regarding a floor for which the diagnosis of the self-closing force abnormality has been made.

The control panel 60 includes a signal unit 61 and a display unit 62 (FIG. 2). The signal unit 61 includes, for example, a rumbling device such as a speaker. Upon receipt of a self-closing force abnormality signal from the car door control device 50 by the control panel 60, the signal unit 61 in the control panel 60 informs, e.g., a maintenance personnel of occurrence of an abnormality in a self-closing force of hall doors by means of a voice and/or a buzzer sound.

The display unit 62 includes, for example, a plurality of LEDs and/or a liquid-crystal display, etc. Upon receipt of a self-closing force abnormality signal from the car door control device 50 by the control panel 60, the display unit 62 in the control panel 60 indicates occurrence of an abnormality in a self-closing force of hall doors. Also, the display unit 62 also indicates information relating to a floor diagnosed as having a self-closing force abnormality together with the indication.

A diagnostic operation of the elevator door control device configured as described above will be described with reference to the flowchart in FIG. 6. Here, as described above, for estimation of a running loss based on a torque value of the door motor 16, it is desirable to minimize an acceleration and a deceleration of a door panel in a door opening/closing motion. However, a decrease in acceleration and deceleration in door opening/closing when a passenger actually uses the relevant elevator may lead to, e.g., operational efficiency reduction.

Therefore, here, a self-diagnostic mode, which is a dedicated operation mode for making diagnosis of whether or not hall doors can self-close based on a torque value of the door motor 16, is provided. Then, the control panel 60 is configured to switch the operation mode of the elevator between the normal operation mode and the self-diagnostic mode.

First, in step S1, the control panel 60 determines whether or not the current state satisfies a predetermined condition for switching to the self-diagnostic mode. Examples of the condition for switching to the self-diagnostic mode may include, e.g., a case where the current time is nighttime and no passengers use the elevator for a fixed period of time or more and a case where a fixed period of time has passed from a previous self-diagnosis.

In step S1, if it is determined that the condition for switching to the self-diagnostic mode is satisfied and a self-diagnosis of a self-closing force is possible, the operation proceeds to the next step S2. In step S2, the control panel 60 switches the operation mode of the elevator to the self-diagnostic mode. Then, in consideration of a case where there is any passenger in the car 10, the control panel 60 performs an operation to urge the passenger in the car 10 to get out of the car (guidance for unloading). For a specific example, the guidance for unloading is performed by turning off illumination inside the car 10 or making an announcement to urge a passenger in the car 10 to get out of the car.

In the following step S3, the control panel 60 moves the car 10 to a floor where diagnosis is intended as to whether or not hall doors can self-close. Then, the operation proceeds to step S4, and the control panel 60 transmits a door open command for a self-closing ability diagnosis to the car door control device 50. Upon receipt of the door open command for self-closing ability diagnosis, the car door control device 50 drives the door motor 16 to open the car door panels 11 and the hall door panels 31.

Here, the car door control device 50 controls the door motor 16 to minimize a speed of movement of the doors in a door open motion, and minimize the acceleration and the deceleration of the doors and make the acceleration and the deceleration have a same degree. Here, "minimize" means making each of the degrees of the movement speed, the acceleration and the deceleration of the doors have a predetermined value or less.

During opening of the doors in step S4, the torque detection unit 51 detects a torque generated by driving of the door motor 16. Then, in step S5, the car door control device 50 checks whether or not the doors are fully opened, based on a detection signal from the car door switch 21. If the doors are not fully opened, the operation returns to step S4.

On the other hand, in step S5, if it is confirmed that the doors are fully opened, the operation proceeds to step S6. In step S6, the storage unit 52 stores the data (torque value) detected by the torque detection unit 51 during the door open motion in step S4. After step S6, the operation proceeds to step S7.

In step S7, the diagnosis unit 53 makes diagnosis of whether or not hall doors of a floor where the diagnosis is intended can self-close, based on the data (torque value) stored in the storage unit 52 in step S6. In the self-closing ability diagnosis, the diagnosis unit 53 first calculates an estimate value of a running loss by subtracting a closer force stored in advance in the storage unit 52 from the torque necessary for door opening, which is stored in the storage unit 52.

Next, the diagnosis unit 53 determines whether or not the calculated estimate value of the running loss is equal or exceeds a predetermined reference value. Then, if the estimate value of the running loss is equal to or exceeds the reference value, the diagnosis unit 53 determines that a self-closing force of the hall doors of the floor where the diagnosis is intended is abnormal. On the other hand, if the estimate value of the running loss is less than the reference value, the diagnosis unit 53 determines that there is no abnormality in the self-closing force of the hall doors of the floor where the diagnosis is intended.

After step S7, the operation returns to step S1, and the processing in the series of steps is repeated. Then, upon an end of a self-closing ability diagnosis for all of the floors where the diagnosis is intended, the control panel 60 returns the operation mode of the elevator to the normal operation mode.

Here, with reference to the flowchart in FIG. 6, a case where a self-closing ability diagnosis is made based on a torque of doors in opening the doors has been described; however, where a self-closing ability diagnosis based on a torque in closing the doors can also be made.

The elevator door control device configured as described above includes: the jointing devices 40, each of which is jointing means for mechanically jointing the car door panels and hall door panels so that the car door panels and the hall door panels open/close in an integrated manner; the hall door closer devices 36, each of which is a closer device that provides a self-closing force in a door close direction to the corresponding hall door panel, and a car door control device 50, which is control means for controlling the motor for driving opening/closing of the car door panels 11.

Then, the control means (car door control device 50) includes a torque detection unit that detects a torque of the motor in at least one of the opening and closing the car door panels and the hall door panels when the car door panels and the hall door panels are jointed to each other, and a diagnosis unit that determines whether or not the hall door panels can self-close by means of a self-closing force provided by the closer device when both panels are not jointed to each other, based on the torque detected by the torque detection unit.

Thus, in an elevator including hall doors each provided with a closer device, it is possible to automatically make diagnosis of whether or not the hall doors can self-close. Furthermore, it is also possible to lengthen a cycle of maintenance by a maintenance personnel, and to early find occurrence of a failure relating to self-closing of the hall doors.

Also, in the elevator door control device configured as described above, in the self-diagnostic mode for diagnosis of whether or not hall door panels can self-close, the control means (car door control device 50) makes the car door panels and the hall door panels open and/or close in such a manner that accelerations and decelerations of both panels have a value that is equal to or less than a predetermined value, and the torque detection unit detects a torque of the motor in at least one of the opening and closing both panels in the self-diagnostic mode.

Thus, from among components including the torque of the motor in opening and closing both panels, a component originating from inertia forces of both panels can be reduced so that the component can be ignored, enabling the diagnostic accuracy to be maintained while processing in the diagnosis unit being simplified.

Furthermore, in the elevator door control device configured as described above further includes a signal unit and/or a display unit, which is means for, if the diagnosis unit determines that the hall door panels cannot self-close, signaling and/or displaying such effect. Thus, it is possible to if a self-close abnormality in a hall door is detected, promptly inform, e.g., a maintenance personnel of such effect.

Embodiment 2

Figure 7:
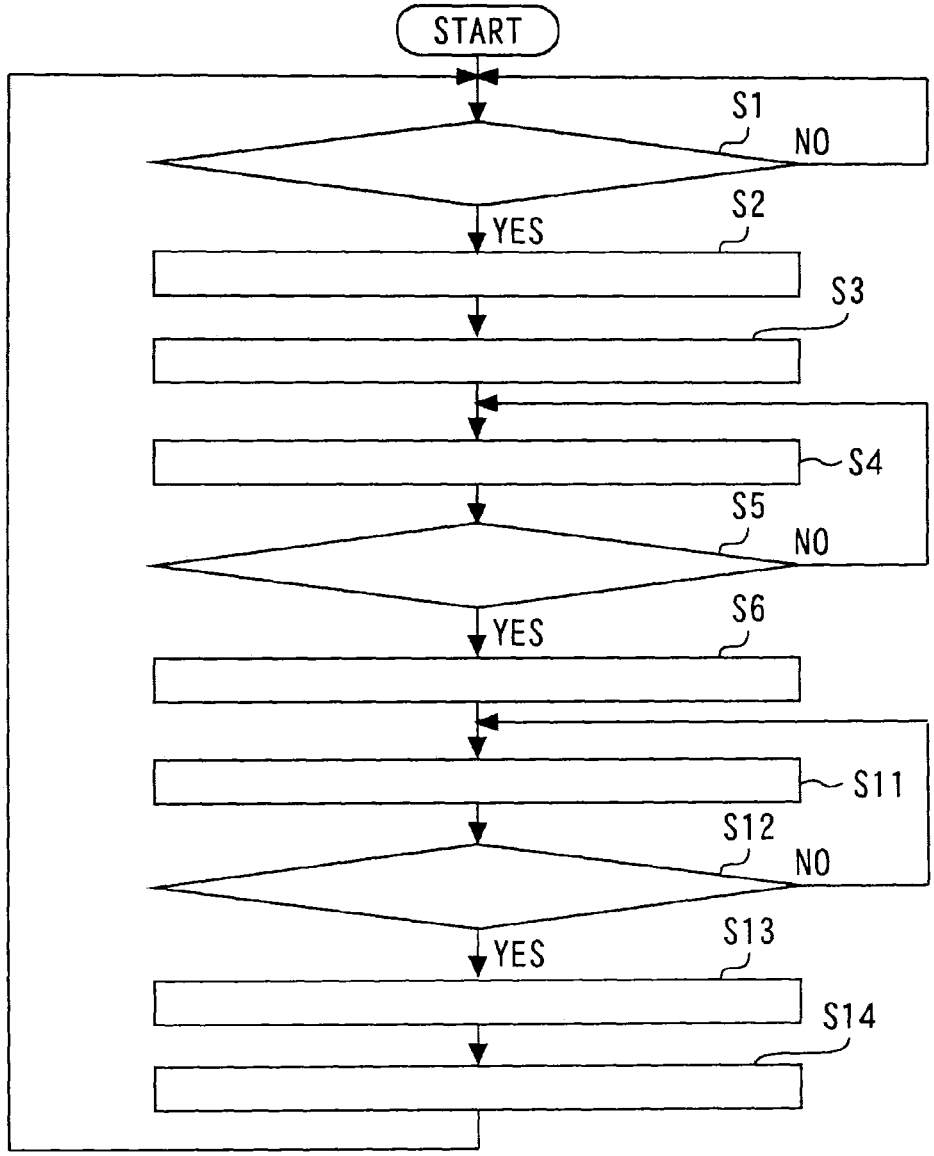
FIG. 7 is a flowchart illustrating operation of an elevator door control device related to Embodiment 2 of the present invention.

FIG. 7 relates to Embodiment 2 of this invention, and is a flowchart illustrating operation of an elevator door control device.

In Embodiment 2 described here, diagnosis of whether or not hall doors can self-close based on both a torque necessary for opening the doors and a torque necessary for closing the doors in the above-described configuration of Embodiment 1.

Comparison between a force necessary for door opening in FIG. 3A and a force necessary for door closing in FIG. 3B, which are used for description of Embodiment 1, shows a relationship between the forces in which the running losses (1) have a same magnitude and are the same in terms of whether the running losses (1) are positive or negative, and the closer forces (2) and the driving forces (3) have a same magnitude but are opposite to each other in terms of whether or not the closer forces (2) and the driving forces (3) are positive or negative, respectively.

Accordingly, as a result of application of the force necessary for door opening and the force necessary for door closing, the closer forces (2) and the driving forces (3) cancel each other out and are thereby set off, respectively, and thus, the running losses (1) remain alone (to be precise, a sum of the running loss in door opening and the running loss in door closing is obtained as a result of such application. As described above, if the running loss in door opening and the running loss in door closing are equal to each other, the running loss in door opening or door closing can be obtained by dividing the sum by 2. In other words, an arithmetic average of the force necessary for door opening and the force necessary for door closing corresponds to a running loss).

Based on such principle, in the self-diagnostic mode, the car door control device 50 first detects a torque of the door motor 16 necessary for door opening when the car door panels 11 and the hall door panels 31 are jointed via the jointing devices 40, by means of the torque detection unit 51. Then, the car door control device 50 stores the detected torque value for door opening in the storage unit 52.

Next, the car door control device 50 detects a torque of the door motor 16 necessary for door closing when the car door panels 11 and the hall door panels 31 are jointed via the jointing devices 40, by means of the torque detection unit 51. Then, the car door control device 50 stores the detected torque value for door closing in the storage unit 52.

As described above, upon an end of detection of both the torques for door opening and door closing, the diagnosis unit 53 performs an operation to obtain an arithmetic average of the torque value for door opening and the torque value for door closing, which are stored in the storage unit 52, to calculate a running loss. Then, the diagnosis unit 53 compares a magnitude of the running loss calculated as described above with a predetermined reference value, and thereby makes diagnosis of whether or not the hall door panels 31 can self-close by means of the hall door closer devices 36.

In Embodiment 2, the values of the closer forces themselves are not used for the diagnosis. Thus, while closer forces are stored in advance in the storage unit 52 in Embodiment 1, it is not necessary to store closer forces in advance in the storage unit 52 in Embodiment 2.

Also, since driving forces are set off using the torque detection results for door opening and door closing, it is not necessary to minimize an acceleration and a deceleration of the doors in the diagnosis as opposed to Embodiment 1. Therefore, it is also possible to make diagnosis of whether or not the hall doors can self-close in the normal operation mode, without using the dedicated self-diagnostic mode. However, for a purpose of preparation for unforeseeable circumstances, it is preferable to make diagnosis of whether or not the hall doors can self-close after switching the operation mode to the self-diagnostic mode.

The rest of the configuration is the same as that of Embodiment 1 and detailed description thereof will be omitted.

A diagnostic operation of the elevator door control device configured as described above will be described with reference to the flowchart in FIG. 7. Here, FIG. 7 indicates a case where whether or not the hall doors can self-close is made in the self-diagnostic mode.

The content of each of the steps S1 to S6 in the flowchart in FIG. 7 is the same as those of steps S1 to S6 of FIG. 6. Therefore, description of these steps will be omitted.

In step S11 following step S6, then, the control panel 60 transmits a door close command for self-closing ability diagnosis to the car door control device 50. Upon receipt of the door close command for self-closing ability diagnosis, the car door control device 50 drives the door motor 16 to close the car door panels 11 and the hall door panels 31.

During opening the doors in step S11, the torque detection unit 51 detects the torque generated by the driving of the door motor 16. Then, in the following step S12, the car door control device 50 checks whether or not the doors are fully closed, based on a detection signal from the car door switch 21. If the doors are not fully closed yet, the operation returns to step S11.

On the other hand, in step S12, if full closing of the door is confirmed, the operation proceeds to step S13. In step S13, the storage unit 52 stores data (torque value) detected by the torque detection unit 51 during the door closing operation in step S4. After step S13, the operation proceeds to step S14.

In step S14, the diagnosis unit 53 makes diagnosis of whether or not hall doors of a floor where the diagnosis is intended can self-close, based on the data (torque value) stored in the storage unit 52 in steps S6 and S13. In this self-closing ability diagnosis, the diagnosis unit 53 first performs an operation to obtain an arithmetic average of a torque necessary for door opening, which is stored in the storage unit 52, and a torque necessary for door closing, which is also stored in the storage unit 52, to calculate a running loss.

Next, the diagnosis unit 53 determines whether or not the calculated running loss is equal to or exceeds a predetermined reference value. Then, if the running loss is equal to or exceeds the reference value, the diagnosis unit 53 determines that the self-closing force of the hall doors of the floor where the diagnosis is intended is abnormal. On the other hand, if the running loss is less than the reference value, the diagnosis unit 53 determines that there is no abnormality in the self-closing force of the hall doors where the diagnosis is intended.

After step S14, the operation returns to step S1, and processing in the series of steps described above is repeated. Then, upon an end of the self-closing ability diagnosis for all of the floors where the diagnosis is intended, the control panel 60 returns the operation mode of the elevator to the normal operation mode.

The elevator door control device configured as described above includes the configuration of Embodiment 1 in which the torque detection unit detects torques of the motor in both opening and closing the car door panels and the hall door panels, and the diagnosis unit adds up the detected torques in door opening and the torque in door closing, which has been detected by the torque detection unit, to calculate the respective running losses of the car door panels and the hall door panels, and based on the calculated running losses, determines whether or not the hall door panels can self-close by means of the self-closing force when the car door panels and the hall door panels are not jointed to each other. Thus, in addition to provision of effects that are similar to those of Embodiment 1, enhancement in accuracy of diagnosis of whether or not hall doors can self-close can be achieved.

Embodiment 3

Figure 8:
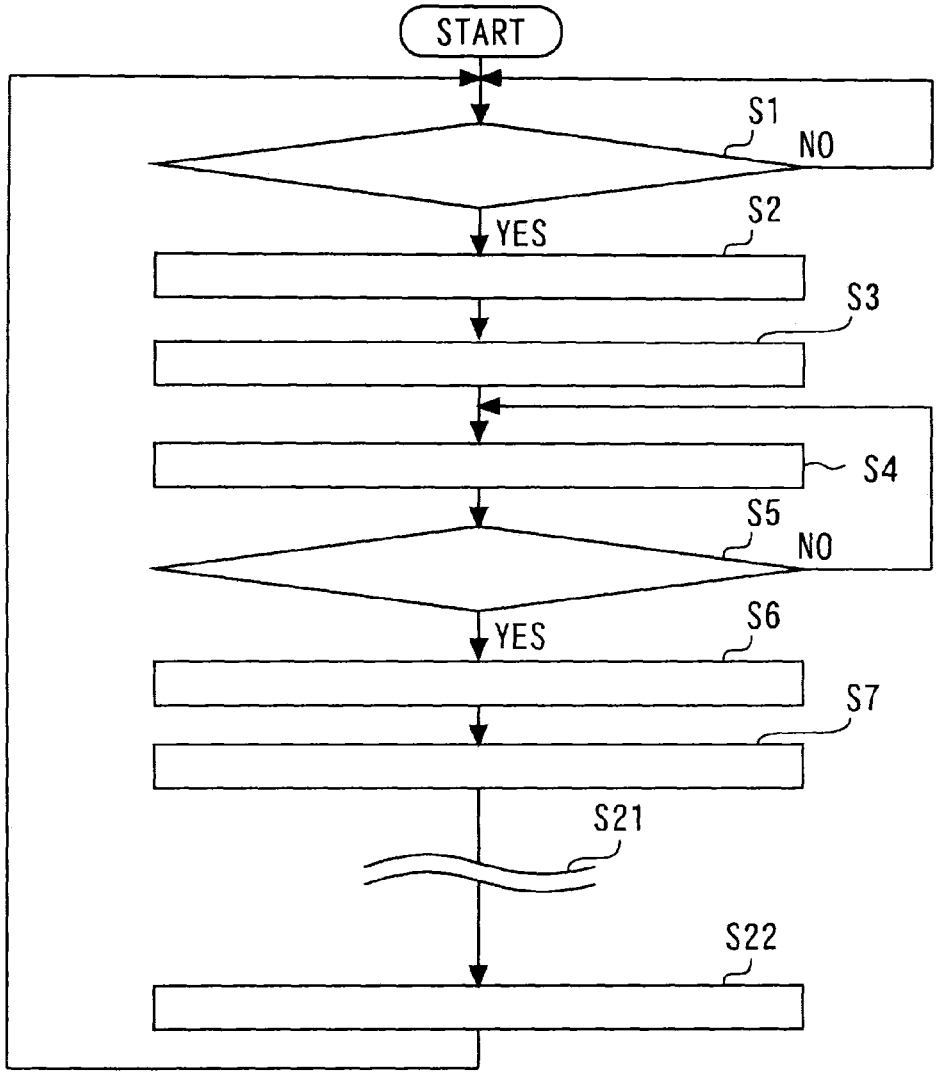
FIG. 8 is a flowchart illustrating operation of an elevator door control device related to Embodiment 3 of the present invention.

FIG. 8 relates to Embodiment 3 of this invention, and is a flowchart illustrating operation of an elevator door control device.

Embodiment 3 described here includes the configuration of Embodiment 1 or Embodiment 2 described above in which diagnosis of whether or not hall doors can self-close is made for a plurality of floors. Then, forces necessary for door opening and/or door closing for the plurality of floors are compared with one another to obtain a difference in hall door running loss among the plurality of floors, and such difference is also used for determination of a hall door self-closing abnormality.

As described in Embodiment 1, a running loss (1) (FIGS. 3A, 3B) necessary for opening/closing when the car door panels 11 and the hall door panels 31 are jointed to each other via the jointing devices 40 includes a car door running loss (1-1) and a hall door running loss (1-2) (FIGS. 4A, 4B).

Here, if the running losses (1) for the plurality of floors are compared with each other, a difference in running loss (1) among the plurality of floors is equal to a difference in hall door running loss (1-2) among the plurality of floors. This is because even though the floor is different, the car 10 is always the same, and thus, the car door running loss (1-1) is always the same.

Therefore, the diagnosis unit 53 compares the running losses with one another, which have been calculated based on the torques necessary for door opening and/or door closing that had been detected for the plurality of floors, to obtain differences in hail door running loss among the respective floors. Next, based on the obtained hall door running loss differences among the respective floors, a minimum value of the hall door running losses in the plurality of floors is obtained.

The minimum value of the hall door running loss obtained as described above can be considered as a value of a running loss when an effect of running loss deterioration due to aging is minimum. Therefore, the magnitude of the hall door running loss in each floor is evaluated with reference to the minimum value of the hall door running loss, whereby the degree of progression of hall door running loss deterioration in each floor can be determined.

Then, based on such principle as described above, if a difference between the hall door running loss in each floor and the minimum value of the hall door running losses in the plurality of floors is equal to or exceeds a predetermined allowable value, the diagnosis unit 53 also determines that there is a problem in self-closing of the hall doors.

The rest of the configuration is similar to that of Embodiment 1 or 2, and detailed description thereof will be omitted.

A diagnostic operation of the elevator door control device configured as described above will be described with reference to the flowchart of FIG. 8. Here, FIG. 8 indicates a case where Embodiment 3 is configured based on the configuration of Embodiment 1.

The content of each of the steps S1 to S7 in the flowchart of FIG. 8 is the same as that of each of the steps S1 to S7 in FIG. 6 described in Embodiment 1. Therefore, description thereof will be omitted.

Step S21 following step S7 indicates that the diagnosis in steps S3 to S7 is made after the floor where the diagnosis is intended is set to a floor that is different from a floor for which a self-closing ability diagnosis has been made last. Step S21 is repeated for the floor where the diagnosis is intended switched from one to another until the self-closing force ability diagnosis is made for all of the floors where the diagnosis is intended. Then, upon an end of the self-closing force ability diagnosis for all of the floors where the diagnosis is intended, the operation proceeds to step S22.

In step S22, the diagnosis unit 53 compares running losses calculated based on torques necessary for door opening, which have been detected for a plurality of floors. Next, based on the result of the comparison, the diagnosis unit 53 obtains a minimum value of hall door running losses in the plurality of floors. Then, with reference to the minimum value of the hall door running losses, the diagnosis unit 53 makes evaluation of the magnitude of the hall door running loss in each floor and hall door self-closing ability diagnosis for each floor. After step S22, the operation returns to step S1.

If the closer force of the hall door closer device 36 is different among the respective floors, hall door running loss comparison and evaluation for the plurality of floors are performed after the difference is corrected in advance.

The elevator door control device described above includes the configuration of Embodiment 1 or 2 in which the torque detection unit detects a torque of the motor in at least one of the opening and closing the car door panels and the hall door panels for a plurality of floors, and the diagnosis unit calculates hall door panel running losses based on the torques in the plurality of floors, which have been detected in the torque detection unit, and based on the calculated running losses, determines whether or not the hall door panels can self-close by means of a self-closing force when the car door panels and the hall door panels are not jointed to each other.

Thus, in addition to provision of effects that are similar to those of Embodiment 1 or 2, diagnosis of whether or not hall door panels can self-close can be made based on evaluation of a running loss of the hall door panels alone, whereby diagnosis accuracy enhancement can be expected.

Embodiment 4

FIG. 9 relates to Embodiment 4 of this invention and a flowchart illustrating operation of an elevator door control device.

Embodiment 4 described here includes any of the configurations of Embodiments 1 to 3 described above in which a history of calculated running losses is stored to use temporal change in running loss in a same floor for hall door self-closing abnormality determination.

Thus, the storage unit 52 stores a history of running loss values calculated by the diagnosis unit 53 for each of floors. Then, for the same floor, the diagnosis unit 53 makes diagnosis of whether or not a hatch of a floor can self-close, based on comparison between the running loss calculated from a torque detected at this time for the floor and a past running loss recorded in the storage unit 52 for the floor.

In this diagnosis, for example, the diagnosis unit 53 determines that there is a problem in self-closing of the hatch of the floor if, e.g., the running loss of this time is larger than a last running loss by a predetermined reference value or more, the running loss of this time is larger than a running loss recorded a fixed period of time before by a predetermined reference value or more, and/or the running loss of this time is larger than an earliest running loss by a predetermined reference value or more.

The rest of configuration is similar to that of any of Embodiments 1 to 3, and detailed description thereof will be omitted.

A diagnostic operation of the elevator door control device configured as described above will be described with reference to the flowchart in FIG. 9. Here, FIG. 8 indicates an example in which Embodiment 4 is configured based on the configuration of Embodiment 3.

The content of each of steps S1 to S7 in the flowchart of FIG. 9 is the same as that of each of steps S1 to S7 in FIG. 6 described in Embodiment 1. Therefore, description of these steps will be omitted.

In step S31 following step S7, the storage unit 52 stores a value of a running loss in a floor where currently diagnosis is intended, the value being calculated in the diagnostic processing in step S7. After step S31, the operation proceeds to step S21. The contents of steps S21 and S22 in FIG. 9 are the same as those of steps S21 and step S22 described in Embodiment 3, respectively. However, in step S21, processing from steps S3 to S31 is repeated.

In step S32 following step S22, for each floor, the diagnosis unit 53 makes diagnosis of whether or not hatch can self-close based on comparison between a running loss calculated this time in the self-diagnostic mode for the floor and a past running loss for the floor, which is recorded in the storage unit 52. As described above, for a reference for this diagnosis, any of those in various methods such as comparison with a last running loss or comparison with a running loss that is a fixed period of time before can be employed. After step S32, the operation returns to step S1.

The elevator door control device configured as described above includes any of the configurations of Embodiments 1 to 3 in which the control means (car door control device 50) further includes a storage unit that stores a history of torques detected by the torque detection unit. Then, the diagnosis unit determines whether or not the hall door panels can self-close by means of a self-closing force when the car door panels and the hall door panels are not jointed to each other, based on the history of the torques stored in the storage unit.

Thus, in addition to provision of effects that are similar to those of any of Embodiments 1 to 3, a running loss increase over time can be detected more accurately, enabling further diagnostic accuracy enhancement.

Embodiment 5

Figure 10A:
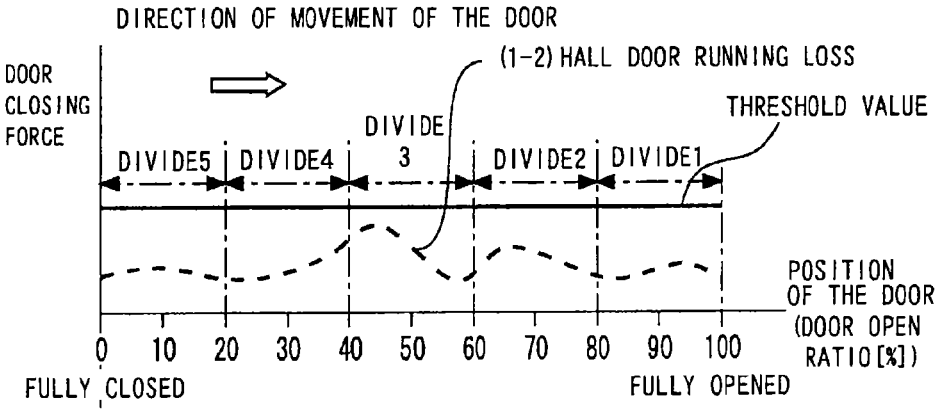
FIGS. 10A, 10B are diagrams illustrating an example of diagnosis regions for an elevator door control device related to Embodiment 5 of the present invention.
Figure 10B:
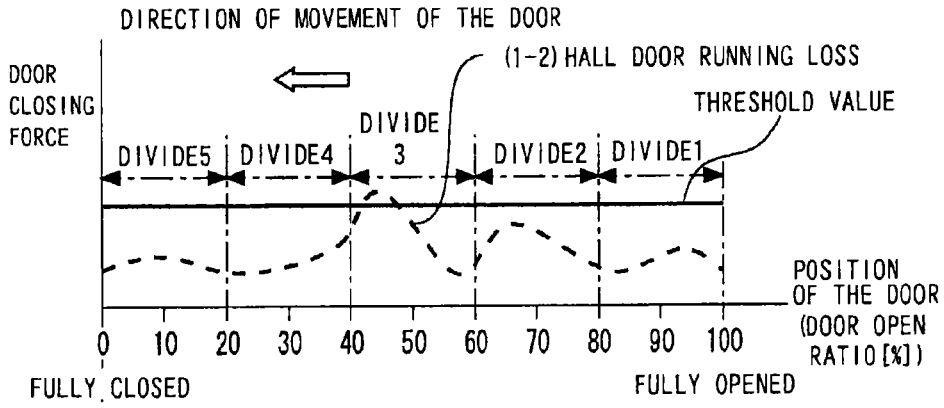

FIGS. 10A, 10B relate to Embodiment 5 of this invention and is a diagram illustrating an example of diagnosis regions for an elevator door control device.

Embodiment 5 described here includes any of the configurations of Embodiments 1 to 4 described above in which door positions in door opening/closing are divided into a plurality of regions, and diagnosis of whether or not hall doors can self-close is made for each of the regions.

In other words, as illustrated in FIGS. 10A, 10B, the range from a full-close position (door close ratio: 0%) to a full-open position (door open ratio: 100%) is divided into a plurality of diagnosis regions. Here, for example, the range is equally divided into five diagnosis regions. More specifically, these diagnosis regions are five regions that are a region of a door close ratio of 0% to 20%, a region of a door close ratio of 20% to 40%, a region of a door close ratio of 40% to 60%, a region of a door close ratio of 60% to 80% and a region of a door close ratio of 80% to 100%.

The torque detection unit 51 detects a torque of the door motor 16 for all of the regions of a door open ratio of 0% to 100% in door opening/closing. The diagnosis unit 53 calculates a running loss of the doors based on the torques detected by the torque detection unit 51. Here, use of the method in which running losses in a plurality of floors are compared with one another, which has been described in Embodiment 3, enables extraction of an amount of variation in running loss in the hall doors from the running losses.

The diagnosis unit 53 determines whether or not the amount of variation in running loss in the hall doors, which has been extracted as described above, exceeds a predetermined threshold value, for each of the diagnosis regions. For example, in the examples indicated in FIGS. 10A, 10B, in FIG. 10A, which indicates door opening, in none of the diagnosis regions, the amount of variation in running loss of the hall doors exceeds the threshold value. Therefore, in this case, the diagnosis unit 53 determines that the hall doors can self-close.

On the other hand, in the example in FIG. 10B, which indicates door closing, in the diagnosis region of a door open ratio of 40% to 60% (division 3), the amount of running loss in the hall doors exceeds the threshold value in the diagnosis region. Therefore, in this case, the diagnosis unit 53 determines that an abnormality occurs in self-closing of the hall doors in the diagnosis region of a door open ratio of 40% to 60%.

If the diagnosis unit 53 diagnoses the hall door panels 31 as being unable to self-close by means of the corresponding hall door closer devices 36 (self-closing force abnormality), for one or more diagnosis regions, the car door control device 50 transmits a self-closing force abnormality signal to the control panel 60. The self-closing force abnormality signal contains information relating to the diagnosis region (s) in which the abnormality occurs in addition to information relating to a floor on which the self-closing force abnormality occurs.

Upon receipt of the self-closing force abnormality signal from the car door control device 50 by the control panel 60, the signal unit 61 signals that an abnormality occurs in the self-closing force of the hall doors, and the display unit 62 indicates that an abnormality occurs in the self-closing force of the hall doors. Here, the display unit 62 also displays information relating to the diagnosis region in which the self-closing force abnormality occurs in addition to information relating to the floor on which the self-closing force abnormality occurs.

The rest of configuration and operation is the same as any of those of Embodiments 1 to 4, and detailed description thereof will be omitted.

The elevator door control device configured as described above includes any of the configuration of Embodiments 1 to 4 in which the diagnosis unit determines whether or not the hall door panels can self-close by means of a self-closing force when the car door panels and the hall door panels are not jointed to each other, based on torques in a plurality of floors, which have been detected by the torque detection unit, for each of a plurality of diagnosis regions obtained by dividing a range from a full-open position to a full-close position of the car door panels and the hall door panels.

Thus, in addition to provision of effects that are similar to those of Embodiments 1 to 4, it is also possible to, upon detection of a hall door self-closing abnormality, obtain information regarding a position at which the self-closing of the hall doors is impaired. Therefore, when a maintenance personnel does maintenance on site, the maintenance personnel can easily determine a part to which he/she should give special attention, enabling reduction of trouble caused for the maintenance.

INDUSTRIAL APPLICABILITY

This invention is applicable to an elevator door control device including a hall door closer device that provides a self-closing force to a hall door panel in a direction in which the door closes, in which when a car door panel and the hall door panel are mechanically jointed to each other via a jointing device, the car door panel is moved by the motor, whereby both of the car door panel and the hall door panel are opened/closed in an integrated manner.

DESCRIPTION OF SYMBOLS

10 car, 11 car door panels, 12 car door hanger, 13 car door rollers, car door rail, 15 car door guide shoe, 16 door motor, 17 drive pulley, 18 driven pulley, 19 drive belt, 20 locking member, 21 car door switch, 30 hall, 31 hall door panels, 32 hall door hangers, 33 hall door rollers, 34 hall door rail, 35 hall door guide shoe, 36 hall door closer device, 40 jointing devices, 41 car-side plates, 42 hall-side roller, 50 car door control device, 51 torque detection unit, 52 storage unit, 53 diagnosis unit, 60 control panel, 61 signal unit, 62 display unit

The invention claimed is:

1. An elevator door control device comprising:

a car door panel configured to open/close an entrance of a car;

a hall door panel configured to open/close an entrance of a hall;

a motor configured to drive the car door panel to open/close;

a jointing device configured to mechanically joint the car door panel and the hall door panel to each other so that the panels open/close in an integrated manner;

a closer configured to provide a self-closing force in a door close direction to the hall door panel; and a controller configured to control the motor, wherein the controller includes:

a torque detector configured to detect a torque of the motor in each of door opening and door closing of the panels when the panels are jointed to each other; and a diagnosis unit configured to determine whether or not the hall door panel is self-closable via the self-closing force when the panels are not jointed to each other, based on the torque detected by the torque detector, wherein the diagnosis unit adds up the torque in the door opening and the torque in the door closing, the torques being detected by the torque detector, to calculate a running loss for the panels, and based on the calculated running loss, determines whether or not the hall door panel is self-closable via the self-closing force when the panels are not jointed to each other.

2. The elevator door control device according to claim 1, wherein the controller makes the panels open and close so as to make magnitudes of an acceleration and a deceleration of the panels be equal to or below a predetermined value in a self-diagnostic mode for making diagnosis of whether or not the hall door panel is self-closable; and wherein the torque detector detects the torque of the motor in each of the door opening and door closing of the panels in the self-diagnostic mode.

3. The elevator door control device according to claim 1, wherein the torque detector detects the torque of the motor in each of door closing and door opening of the panels for each of a plurality of floors; and wherein the diagnosis unit calculates a running loss for the hall door panel based on the torques detected by the torque detector for the plurality of floors, and based on the calculated running loss, determines whether or not the hall door panel is self-closable via the self-closing force when the panels are not jointed to each other.

4. The elevator door control device according to claim 1, wherein the controller further includes a storage unit that stores a history of a torque detected by the torque detector; and wherein the diagnosis unit determines whether or not the hall door panel is self-closable via the self-closing force when the panels are not jointed to each other, based on the history of the torque stored in the storage unit.

5. The elevator door control device according to claim 1, wherein the torque detector detects the torque of the motor in each of door closing and door opening of the panels for each of a plurality of floors, and wherein the diagnosis unit determines whether or not the hall door panel is self-closable via the self-closing force when the panels are not jointed to each other, for each of a plurality of diagnosis regions obtained by dividing a range from a full-open position to a full-close position of the panels, based on the torques detected by the torque detector for the plurality of floors.

6. The elevator door control device according to claim 1, further comprising means for, if the diagnosis unit determines that the hall door panel is not self-closable, signaling and/or displaying the effect.

* * * * *